US011000753B2

(12) United States Patent
Kim

(10) Patent No.: US 11,000,753 B2
(45) Date of Patent: May 11, 2021

(54) PERSONAL FITNESS DEVICE USING VR

(71) Applicant: Jong Burm Kim, Suwon-si (KR)

(72) Inventor: Jong Burm Kim, Suwon-si (KR)

( * ) Notice: Subject to any disclaimer, the term of this patent is extended or adjusted under 35 U.S.C. 154(b) by 64 days.

(21) Appl. No.: 16/551,744

(22) Filed: Aug. 27, 2019

(65) Prior Publication Data

US 2020/0086197 A1 Mar. 19, 2020

(30) Foreign Application Priority Data

Sep. 19, 2018 (KR) ..... 10-2018-0111985

(51) Int. Cl.
*A63B 71/06* (2006.01)
*A63B 21/00* (2006.01)
(Continued)

(52) U.S. Cl.
CPC ..... *A63B 71/0622* (2013.01); *A63B 21/0083* (2013.01); *A63B 21/0442* (2013.01);
(Continued)

(58) Field of Classification Search
CPC ..... A63B 21/0083; A63B 21/0442; A63B 21/4009; A63B 21/4021; A63B 21/4035; A63B 21/4045; A63B 23/03516; A63B 23/12; A63B 23/1209; A63B 23/1218; A63B 24/0006; A63B 24/0059; A63B 24/0075; A63B 24/0087; A63B 71/0054; A63B 71/0622; A63B 2024/0025; A63B 2024/0068; A63B 2024/0096; A63B 2071/009; A63B 2071/0627; A63B 2071/063; A63B 2071/0638; A63B 2071/0647; A63B 2071/0666; A63B 2209/10; A63B 2220/10; A63B 2220/20; A63B 2220/51; A63B 2220/56; A63B 2220/801; A63B 2220/806; A63B 2220/807; A63B 2220/8033; A63B 2220/8036; A63B 2225/093;
(Continued)

(56) References Cited

U.S. PATENT DOCUMENTS 5,372,564 A * 12/1994 Spirito ..... A63B 23/03533 482/111
6,152,854 A * 11/2000 Carmein ..... A63B 22/025 482/4
(Continued)

FOREIGN PATENT DOCUMENTS

KR 10-2009-0122875 A 12/2009
KR 10-2012-0052783 A 5/2012
(Continued)

*Primary Examiner* — Megan Anderson

(57) ABSTRACT

Provided is a personal fitness machine device using VR including: a driving unit collecting front location information of a user and front posture information of the user; a VR unit which collects rear location information, rear posture information, and distance information of the user; an exercise unit including a bottom frame, a footrest unit, a separation prevention unit, a back support frame, and a waist protector; and a control unit which controls the driving unit, the VR unit, and the exercise unit, compares the front posture information of the user and pre-stored posture information, and generates posture correction information.

8 Claims, 8 Drawing Sheets

(51) Int. Cl.

| | |
|---|---|
| ***A63B 21/008*** | (2006.01) |
| ***A63B 21/04*** | (2006.01) |
| ***A63B 23/035*** | (2006.01) |
| ***A63B 23/12*** | (2006.01) |
| *A63B 24/00* | (2006.01) |

(52) U.S. Cl.
CPC ..... *A63B 21/4009* (2015.10); *A63B 21/4021* (2015.10); *A63B 21/4035* (2015.10); *A63B 23/03516* (2013.01); *A63B 23/12* (2013.01); *A63B 23/1209* (2013.01); *A63B 24/0006* (2013.01); *A63B 2024/0068* (2013.01); *A63B 2071/0638* (2013.01); *A63B 2071/0647* (2013.01); *A63B 2220/56* (2013.01); *A63B 2220/806* (2013.01); *A63B 2220/807* (2013.01); *A63B 2230/00* (2013.01)

(58) Field of Classification Search
CPC ..... A63B 2225/15; A63B 2225/50; A63B 2225/74; A63B 2230/00; A63B 2230/62
See application file for complete search history.

(56) References Cited

U.S. PATENT DOCUMENTS

| | | | | |
|---|---|---|---|---|
| 6,821,233 | B1 * | 11/2004 | Colombo | A61F 5/0102 482/54 |
| 7,125,388 | B1 * | 10/2006 | Reinkensmeyer | A63B 69/0064 601/5 |
| 7,780,573 | B1 * | 8/2010 | Carmein | A63B 71/0622 482/4 |
| 9,861,856 | B1 * | 1/2018 | Miller | A63B 24/0087 |
| 9,868,026 | B2 * | 1/2018 | Marcandelli | A63B 21/0087 |
| 10,192,454 | B2 * | 1/2019 | Cakmak | A63F 13/42 |
| 10,286,313 | B2 * | 5/2019 | Goetgeluk | A63F 13/5255 |
| 10,668,352 | B2 * | 6/2020 | Wang | A63B 71/0054 |
| 2004/0143198 | A1 * | 7/2004 | West | A61F 5/0102 601/5 |
| 2011/0164044 | A1 * | 7/2011 | Huang | A63B 71/0622 345/473 |
| 2019/0232113 | A1 * | 8/2019 | Zets | A63B 24/0075 |

FOREIGN PATENT DOCUMENTS

| | | | |
|---|---|---|---|
| KR | 10-2015-0109547 | A | 8/2015 |
| KR | 10-2018-0009473 | A | 1/2018 |
| KR | 10-1829790 | B1 | 2/2018 |
| KR | 10-1854129 | 81 | 4/2018 |
| KR | 10-1875038 | B1 | 6/2018 |

* cited by examiner

PERSONAL FITNESS DEVICE USING VR

TECHNICAL FIELD

The present invention relates to a personal fitness machine device using virtual reality (VR). More particularly, when a user exercises in a VR space, the personal fitness machine using VR collects information about a current exercise posture of a user (exerciser) through a VR tracker or a Kinect sensor, etc., guides the current exercise posture to be corrected based on collected information, and allows the user to efficiently perform various whole body exercises safely in a predetermined space.

BACKGROUND OF INVENTION

In general, in order to exercise without injury, it is important to perform an exercise with correct movements. To do so, an exerciser, who performs an exercise, may learn how to exercise from a trainer in a fitness center or from watching videos online and performing exercise movements looking at a mirror.

However, employing a personal trainer to perform personal training (PT) has drawbacks. Employing a personal trainer is expensive. It requires the exerciser to coordinate time with a trainer, making it difficult for a busy modern person to exercise at a fixed time every time.

In addition, exercising alone through internet videos is boring. Also, to be effective, exercise must be made on a regular basis, e.g., at least three times a week. However, many exercisers give up because it is difficult to keep.

A Kinect sensor released by Microsoft allows a user to exercise watching himself or herself mirrored on a screen and following the movement of a trainer figure next to him. However, such an exercise only operates on a game machine called XBOX, limiting its users to people who enjoy games rather than exercise. In addition, the exercise using the Kinect sensor is unpopular because it needs to purchase a specific game machine.

On the other hand, in the Korean Patent No. 10-1829790, an exercise support apparatus using VR has been disclosed. In the patent, a smart device which an exerciser exercises with and a VR application provided in the smart device generate information about exercise amount, configure relevant information about exercise state, and display the information as VR through a VR head.

However, the prior art mentioned above only generates a user's exercise information using a smart device and displays the information through VR. Therefore, it still has various disadvantages found in the conventional method of exercising through online videos.

DETAILED DESCRIPTION

Problem to be Solved

The present invention is made to solve the above-mentioned problems and provides a personal fitness machine device using VR. When a user performs an exercise in a virtual space, the device according to the present invention collects information about the user's current exercise posture through cameras, a VR tracker and a Kinect sensor, etc., allows the user to check the collected information about the user's current exercise posture in the virtual space in real time, and guides the user to correct the current exercise posture based on the information collected about the user's exercise posture.

Another objective of the present invention is to provide a personal fitness machine device using VR that, when a user is correcting the current exercise posture, can improve an effect of an exercise by providing a correction voice message from the virtual trainer who is existing only in the virtual space. The user can select the trainer at user's taste.

In addition, the present invention provides a personal fitness machine device using VR that, when a user performs an exercise in the virtual space, makes the exercise more effective by providing exercise equipment for the user to exercise directly in the real space. With such a feature, it is possible for the user to exercise in an accurate and correct posture in both the virtual space and the reality space.

In addition, according to the personal fitness machine device using VR of the present invention, an exercise is performed not only in the virtual space but also in the real space, allowing a user to efficiently perform a variety of full-body exercise in a limited space.

In addition, the present invention provides a personal fitness machine device using VR that, when a user performs an exercise in the virtual space, makes it possible to exercise more enjoyably and effectively by creating a variety of environments in the virtual space.

In addition, the present invention provides a personal fitness machine device using VR that, when an exercise is performed in both the virtual space and the real space, maximizes an effect of the exercise and increases the motivation and enjoyment of the exercise by measuring the amount of exercise of the user and providing a variety of guidance messages such as praise, cheer, or comfort from the virtual trainer according to the measured result.

However, the objectives of the present invention are not limited thereto. Even if not explicitly mentioned, the objective or effect that can be understood from the solutions or embodiments is also an objective of the present invention.

Solutions to Solve the Problems

According to an embodiment of the present invention for achieving the above purpose, the present invention includes: a driving unit collecting front location information of a user and front posture information of the user, displaying virtual image information of the user in a virtual space, and including an exercise device with which the user exercises both in the virtual space and in a reality space; a VR unit including a control body and a side body and defining an exercise space of the user, wherein the control body collects rear location information, rear posture information, and distance information of the user, wherein the side body is provided on a side of the control body and is rotatably coupled to the driving unit; an exercise unit including a bottom frame, a footrest unit, a separation prevention unit, a back support frame, and a waist protector, wherein the footrest unit is rotatably coupled onto the bottom frame, wherein the separation prevention unit is provided on an outer circumference the footrest unit and prevents the user from departing from the footrest while the user exercises, wherein the waist protector is connected to the back support frame; and a controller coupled to the driving unit, wherein the controller controls the driving unit, the VR unit, and the exercise unit, compares the front posture information of the user and pre-stored posture information, and generates posture correction information, wherein the front posture information of the user is transmitted from the driving unit, wherein the pre-stored posture information is pre-stored in a database.

According to an embodiment of the invention, the driving unit comprises: a front camera which collects the front posture information of the user a front laser sensor which collects front distance information between the driving unit and the user; a display unit which displays the virtual image information of the user in the virtual space and reality image information of the user in the reality space; an authentication and payment unit which authenticates the identity of the user and processes payment; a first workout unit which the user uses for exercise in the reality space; a user detection sensor which collects location and movement information of the user; a second workout unit which the user uses for exercise, e.g., muscle exercises for the biceps and triceps, in the reality space; and a computer which is controlled by the controller to drive the first handle and the second handle and displays information transmitted from the controller on the display unit.

According to an embodiment of the present invention, the first workout unit comprises: a first handle; a rotation bar which allows the first handle to move toward the user; a support bar connecting the rotation bar to the first handle; a first driving member which is controlled by the computer and rotates the rotating bar at a first angle; and a stopper panel which prevents the rotation bar from rotating beyond the first angle.

According to an embodiment of the present invention, the second workout member comprises: a second handle; a second driving member which allows the second handle to move at a second angle toward the user; a variable wire which is coupled to the second handle and allows the second handle to be pulled into and pulled out from the second workout member; a piston which is coupled to an end of the variable wire and allows the variable wire to be pulled out at a first tension; and a pressure controller which adjusts the first tension.

According to an embodiment of the present invention, the controller controls and rotates at 360 degrees the front camera and a rear camera, wherein the front camera is coupled to the driving unit, wherein the rear camera is coupled to the VR unit.

According to an embodiment of the invention, the control body comprises: a rear camera which collects the rear location information of the user and the rear posture information of the user; a rear laser sensor generating rear distance information between the user and the control body; and a VR accommodating unit which interacts with the controller and receives a headset, a VR device, and a VR tracker sensor, wherein the headset, the VR device, and the VR tracker sensor connect the reality space to the virtual space.

According to an embodiment of the present invention, the bottom frame further comprises: a rotating member which is provided inside the bottom frame and rotates the footrest unit with respect to the bottom frame.

According to an embodiment of the present invention, the controller provides a trainer selection menu, wherein the trainer selection menu allows the user to select a virtual trainer in the virtual space and allows the user to configure the virtual space.

Advantages of the Invention

According to the device of an embodiment of the present invention, when a user performs an exercise in a virtual space, the device helps the user to perform the exercise with correct posture by collecting information about the user's current exercise posture, allowing the user to check the collected information about the user's current exercise posture in the virtual space in real time, and guiding the correction of the current exercise posture based on the information collected about the user's exercise posture.

In addition, according to an embodiment of the present invention, when a user is correcting the current exercise posture, the present invention can improve an effect of an exercise by providing correction voice message from the virtual trainer existing only in the virtual space. The trainer is selected according to the user's taste.

In addition, according to an embodiment of the present invention, when a user performs an exercise in the virtual space, the device of the present invention makes the exercise more effective by providing exercise equipment for the user to exercise directly in the real space. Thus, it is possible for the user to exercise in an accurate and correct posture in both the virtual space and the real space.

In addition, according to an embodiment of the present invention, when an exercise is performed not only in the virtual space but also in the real space, the device of the present invention allows a user to efficiently perform a variety of full-body exercise in a limited space.

In addition, according to an embodiment of the present invention, when a user performs an exercise in the virtual space, the device of the present invention makes it possible for a user to exercise more enjoyably and effectively by creating a variety of environments in the virtual space.

In addition, according to an embodiment of the present invention, when an exercise is performed in both the virtual space and the real space, the device of the present invention maximizes an effect of the exercise and increases the motivation and enjoyment of the exercise by measuring the amount of exercise of the user in real time and providing a variety of guidance messages such as praise, cheer, or comfort from the virtual trainer according to the measured result.

According to an embodiment of the present invention, in addition to fitness, a user can also expect posture correction treatment such as turtle neck and physical therapy. The posture correction can be made with a virtual trainer (or a virtual therapist).

In addition, various and beneficial advantages and effects of the present invention is not limited to those above mentioned. Advantages and effects will be more easily understood in reference to the following embodiments.

EMBODIMENTS

Figure 1:
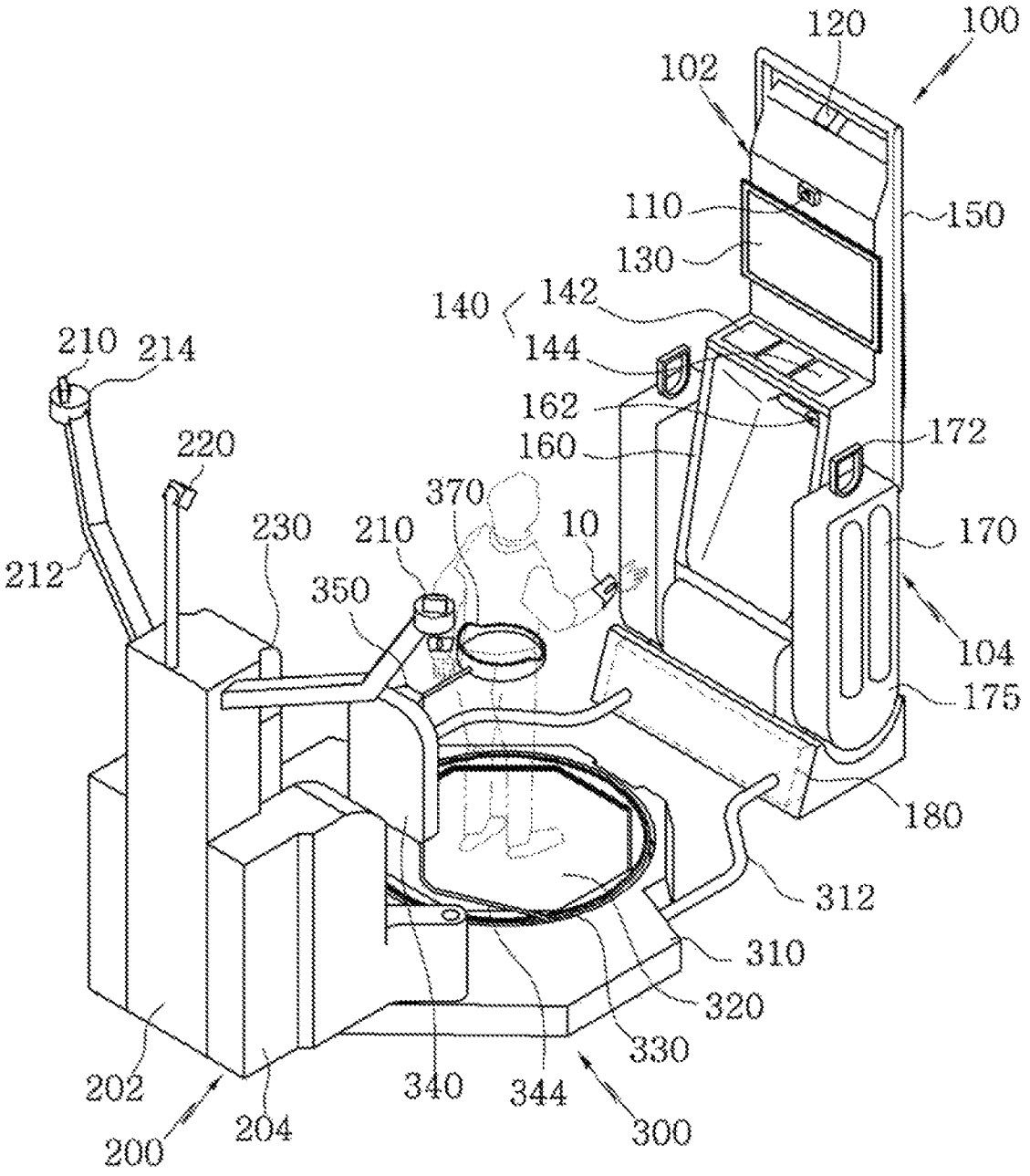
FIG. 1 is a perspective view schematically showing a personal fitness machine device using VR according to an embodiment of the present invention.

Hereinafter, exemplary embodiments of the present invention will be described in detail with reference to the accompanying drawings. First, in drawing, the same reference numerals are used to refer to the same or similar components. In addition, in describing the present invention, explanation on conventional components or functions may be omitted to avoid and reduce confusion.

In addition, in describing the components of the present invention, terms, such as first, second, A, B, (a), and (b) can be used. Such terms are only for distinguishing components from other components, and the nature or the order of the components are not limited by the terms. When a first component is described with the wordings such as "attached," "coupled," or "connected" to a second component, the first component may be directly attached or connected to the second component, or may be directly attached or connected to the second component through a third component.

Figure 2:
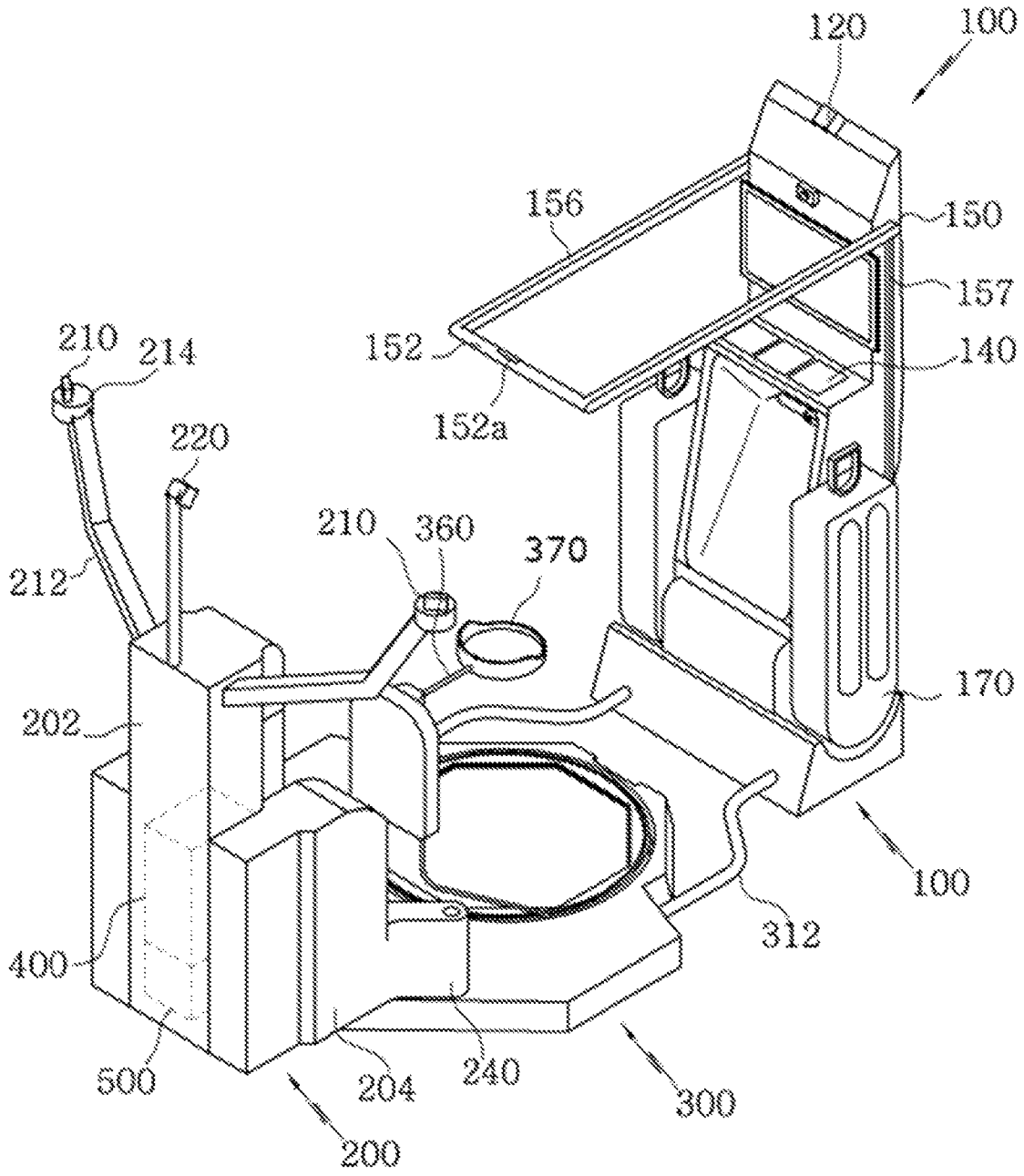
FIG. 2 is a personal fitness machine device using VR according to an embodiment of the present invention with a first workout unit in operation.
Figure 3:
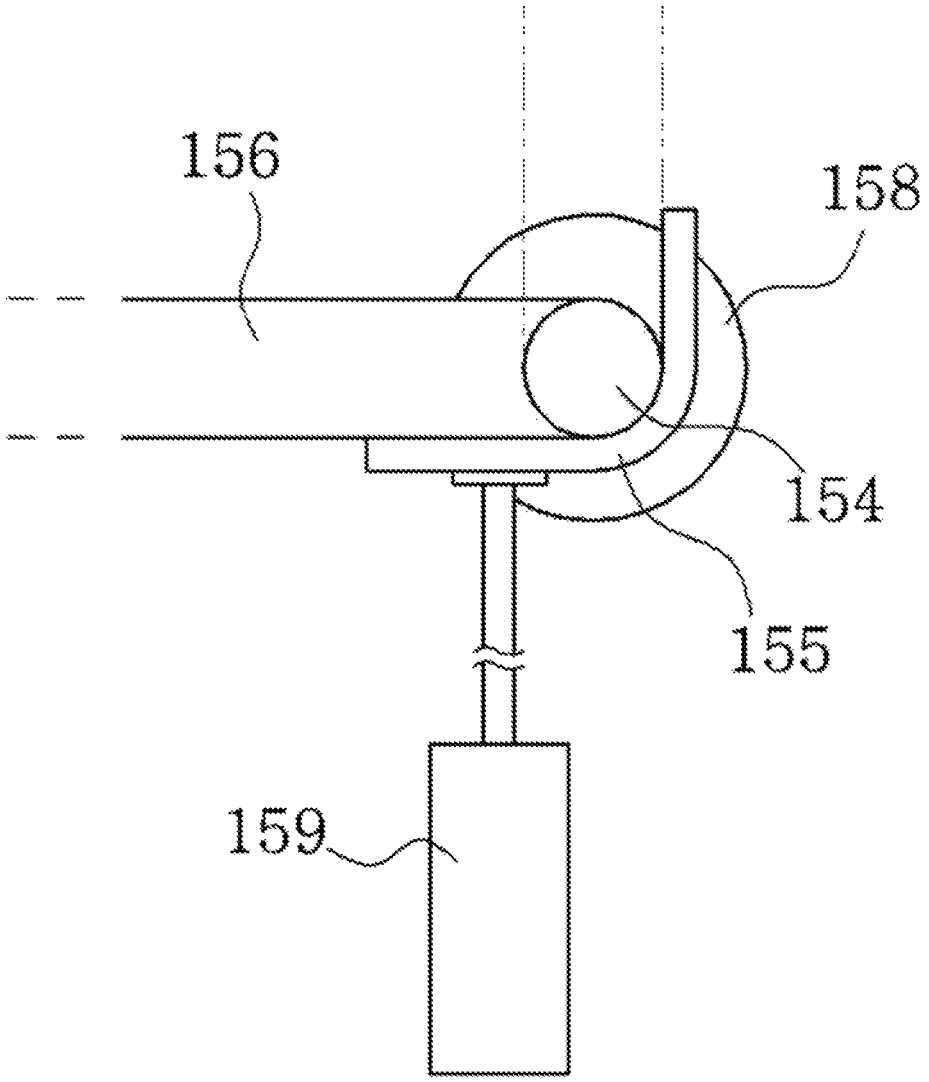
FIG. 3 is a view schematically showing a configuration of the first workout unit of the personal fitness machine using VR according to an embodiment of the present invention.

FIG. 1 is a perspective view schematically showing a personal fitness machine device using VR according to an embodiment of the present invention. FIG. 2 is a personal fitness machine device using VR according to an embodiment of the present invention with a first workout unit in operation. FIG. 3 is a view schematically showing a configuration of the first workout unit of the personal fitness machine using VR according to an embodiment of the present invention.

Figure 4:
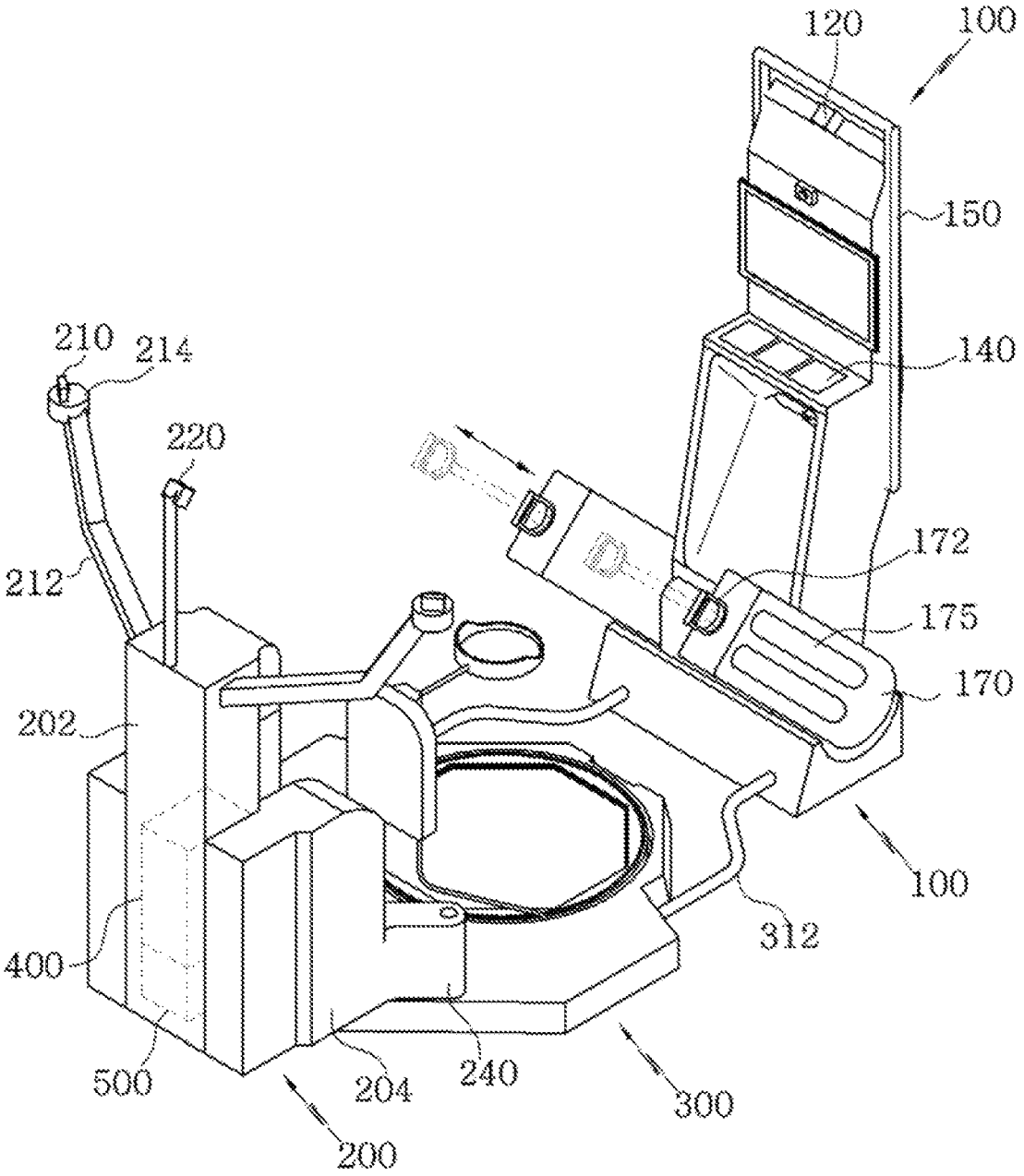
FIG. 4 is a personal fitness machine device using VR according to an embodiment of the present invention with a second workout unit in operation.
Figure 5:
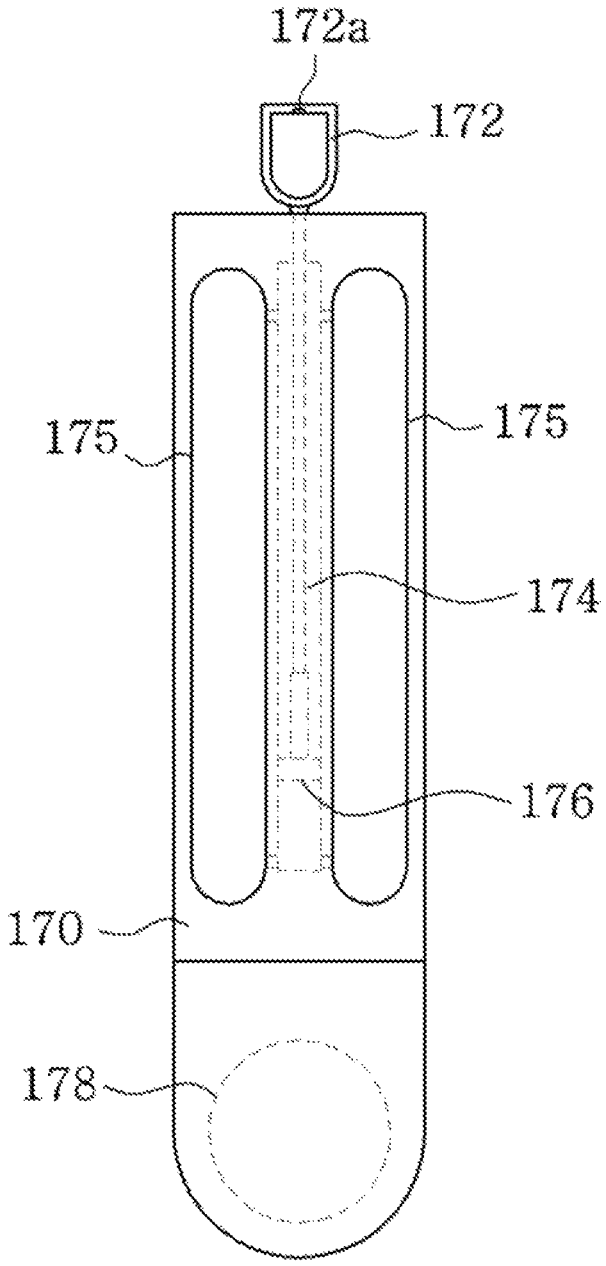
FIG. 5 is a view schematically showing a configuration of the second workout unit of the personal fitness machine using VR according to an embodiment of the present invention.
Figure 6:
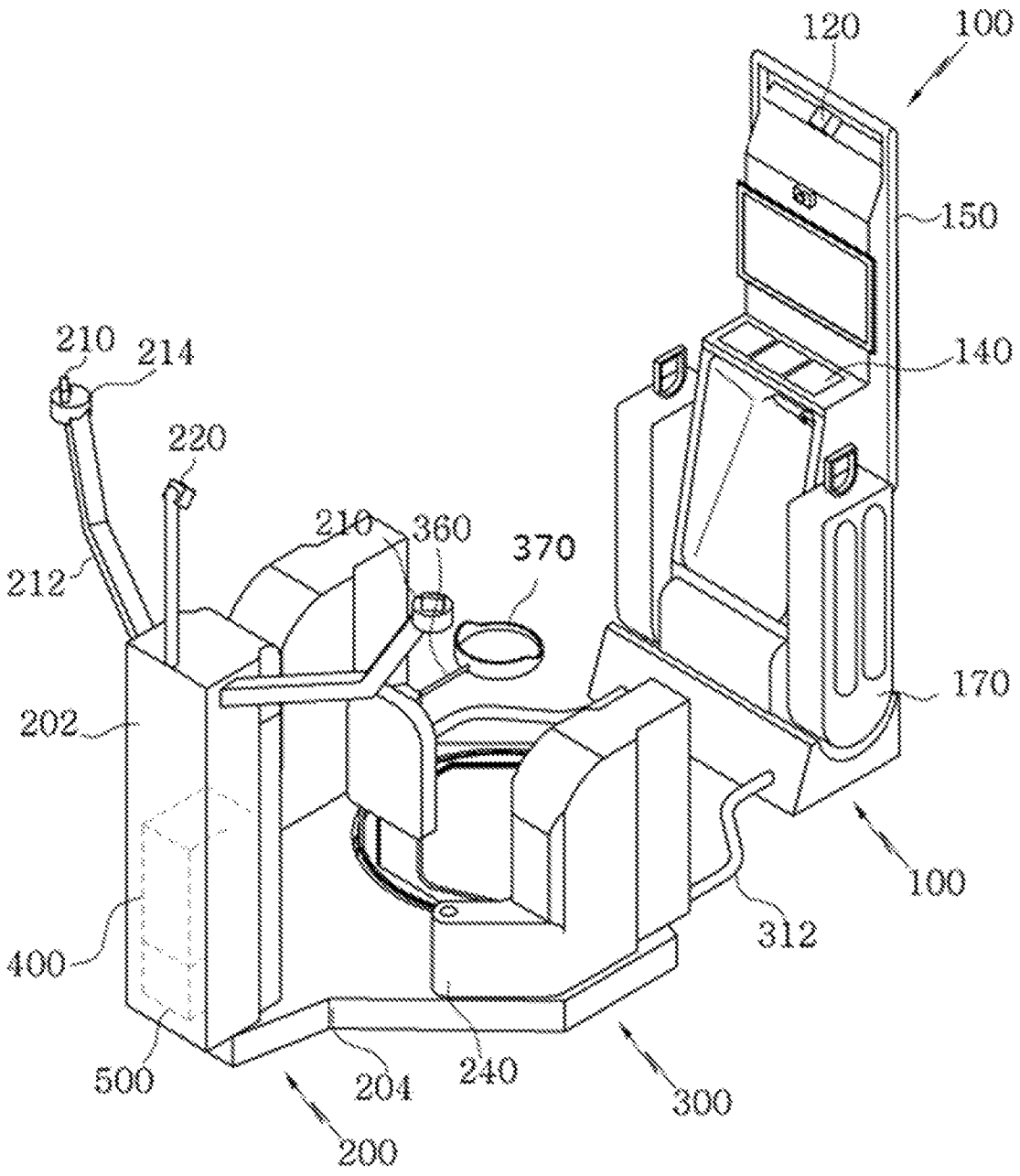
FIG. 6 is a personal fitness machine device using VR according to an embodiment of the present invention with a side body in operation.
Figure 7:
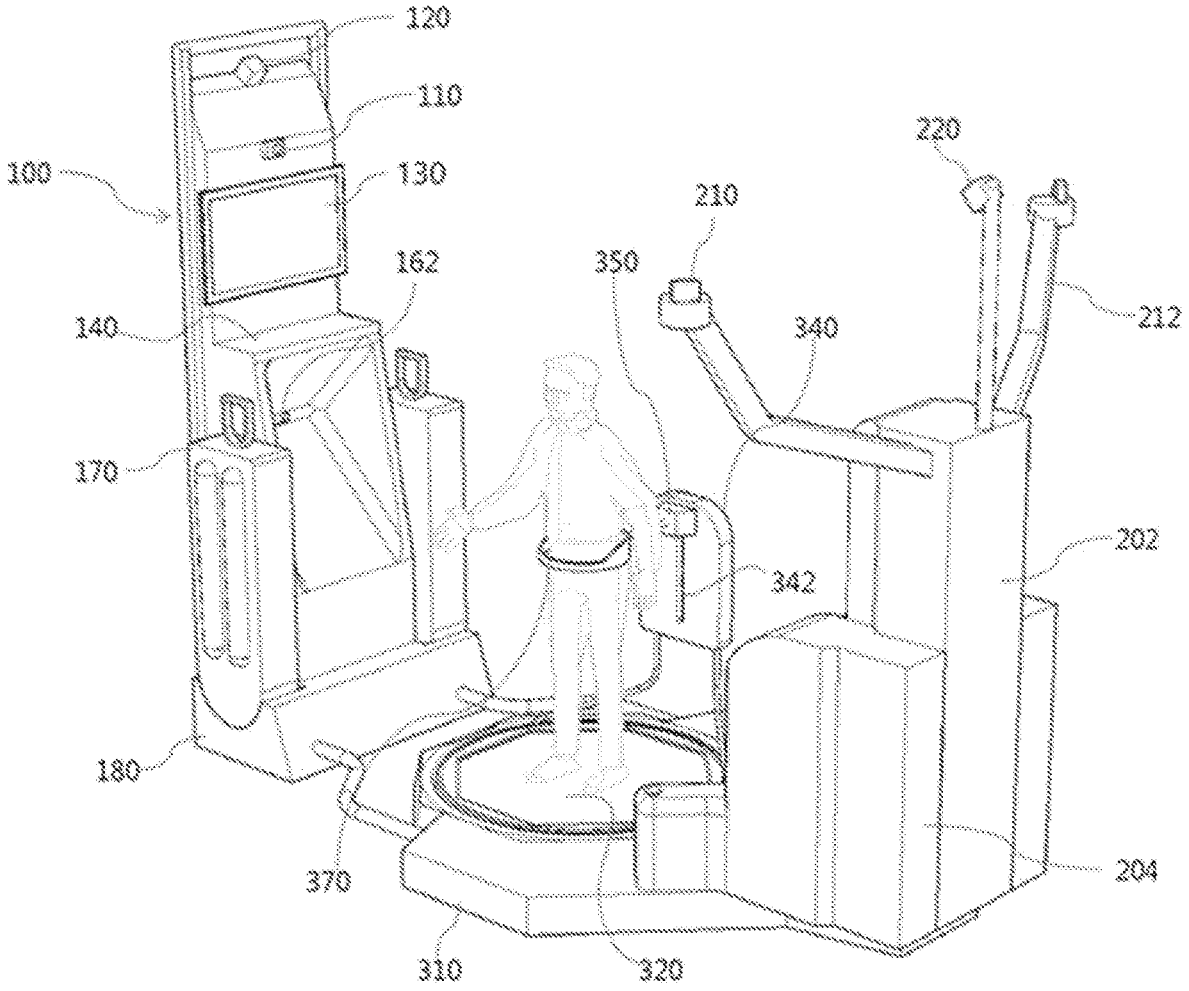
FIG. 7 and FIG. 8 show a personal fitness machine device using VR according to an embodiment of the present invention with a footrest unit in operation.
Figure 8:
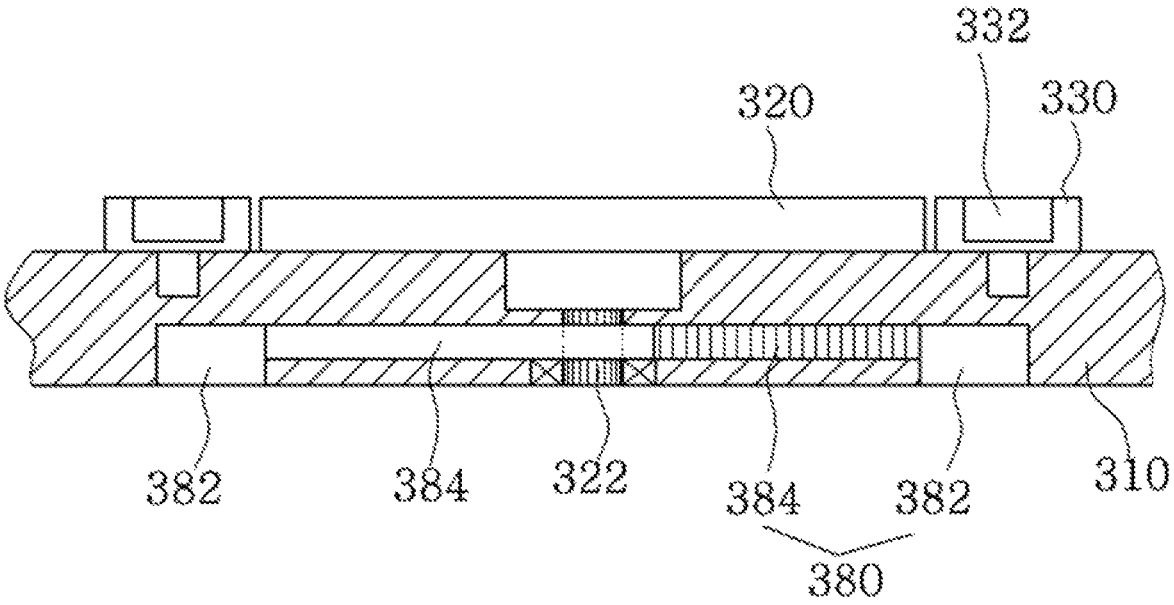

FIG. 4 is a personal fitness machine device using VR according to an embodiment of the present invention with a second workout unit in operation. FIG. 5 is a view schematically showing a configuration of the second workout unit of the personal fitness machine using VR according to an embodiment of the present invention. FIG. 6 is a personal fitness machine device using VR according to an embodiment of the present invention with a side body in operation. FIG. 7 and FIG. 8 are a personal fitness machine device using VR according to an embodiment of the present invention with a footrest unit in operation.

As shown, when a user performs an exercise in a virtual reality (VR) space (hereinafter referred to as a virtual space), the personal fitness machine using VR of the present invention allows the user to perform actual exercise in the real space. To do so, the personal fitness machine using VR includes: a driving unit (100) that provides an exercise device to the user in a real space (or reality space); a VR unit (200) that is located in front of the driving unit (100), is spaced apart a predetermined interval from the driving unit (100), is provided on the back of the user, and provides VR fitness service to the user, an exercise unit (300) that is located between the driving unit (100) and the VR unit (200) and provides an exercise space where the user can safely perform the exercise; and a controller (400) that is built in the VR unit (200) and provides VR fitness service to the user.

The driving unit (100) includes an upper driving unit (102) and a lower driving unit (104), collects front location and motion information of a user, and displays a virtual image of the user in the virtual space. When a user who is in the virtual space (hereinafter referred to as a virtual user) performs an exercise, the driving unit (100) provides an exercise device with which a user who is in the real space (hereinafter referred to as a user) can do a bare-hand exercise.

The upper driving unit (102) forms an upper portion of the driving unit (100) and comprises a front camera (110) and a front laser sensor (120) for collecting front motion information and location information of the user who is located on a footrest unit (320) of an exercise unit (300).

The front camera (110) photographs front motion information of the user and transmits the front motion information to a computer (180) configured in a lower driving unit (104). The lower driving unit (104) will be described in detail later.

The front camera (110) may be configured with at least one camera driving actuator that rotates 360 degrees for up, down, left, and right directions under the control of the controller (400) which will be described later. Accordingly, the front view of the user can be photographed at various angles and transmitted to the computer (180) to obtain information on the exercise posture of the user performing the exercise and generate posture correction information based on the acquired exercise posture information, allowing correction of the exercise posture of the user.

The front laser sensor (120) collects the location information of the user by measuring the distance value between the location of the front laser sensor (120) and the location of the user and transmitting the measured result to the computer (180).

The upper driving unit (102) includes a display unit (130) displaying both the image information of the virtual user performing the exercise in the virtual space and the image information of the user performing the exercise in the real space.

The display unit (130) is configured to display image information transmitted from the computer (180), but is not limited thereto. When exercise amount information of the user (the virtual user and the user) is transmitted from the computer (180), the exercise amount information is displayed. When the exercise amount information changes in real time, the exercise amount information in real time is displayed.

In addition, an authentication and payment unit (140) is provided at a lower end of the upper driving unit (102) for the authentication of the user and payment for using the personal fitness machine of the present invention. The authentication and payment unit (140) guides the user to sign up and includes an authentication unit (142) for performing member authentication if the user is an existing member and a payment unit (144) including NFC, IC reader, card reader, etc. for performing payment for using the personal fitness machine.

Here, the authentication unit (142) may be configured to be authenticated using number information of a user's portable terminal such as a user's smartphone. In another embodiment, authentication can be made by a short-range communication method with the portable terminal.

In an embodiment, the upper driving unit (102) is provided with a first workout unit (150), e.g., a bar. When a virtual user performs a bare hand exercise, e.g., using a bar, as a virtual user in a virtual space, the user corresponding to the virtual user can do an actual exercise using the first workout unit (150), e.g., the bar. The first workout unit (150) is coupled to both sides of the upper driving unit (102) in such a manner of moving up and down and rotating only by a predetermined angle with respect to the upper driving unit (102).

In an embodiment, the first workout unit (150) may be controlled by the computer (180) to perform only the lifting and lowering operation. In another embodiment, the rotational angle of the first workout unit (150) can be controlled by the first workout unit (150). The first workout unit (150) includes a first handle (152) to be gripped when the user performs a bare hand exercise using, e.g., a bar; a rotation bar (154) that moves the first handle (152) toward the user; a support bar (156) that connects the rotation bar (154) and the first handle (152) to each other and supports the user's weight when the user performs the bar exercise; and a first driving member (158) that rotates the rotation bar (154) by only a predetermined angle under the control of the computer (180).

The first handle (152) may further include a first contact sensor (152*a*) that detects a contact between the first handle (152) and a user's hand and transmits a contact signal to the controller (400) when a contact is detected.

The first workout unit (150) may further includes a stopper panel (155). The stopper panel (155) may prevent the rotation bar (154) from rotating beyond a certain angle. The stopper panel (155) may accommodate the lower surface of the support bar (156) when the user performs a bare hand exercise, enhancing the bearing force on the support bar (156). In addition, the first workout unit (150) is configured to move up and down adjustable to the height of the user. When not in use, it is preferable the first workout unit (150) remains in close contact with both sides of the upper driving unit (102).

The first workout unit (150) may further include a lifting hole (157) and a lifting member (159). The lifting hole (157) is formed at a side of the upper driving unit (102) and guides the rotation bar (154) to move up and down. The lifting member (159) is coupled to a lower end of the rotation bar (154) or a lower surface of the stopper panel (155) and lifts and lowers the first workout unit (150) under the control of the computer (180). The lifting member (159) may be a pneumatic cylinder or a hydraulic cylinder, but is not limited thereto.

The lower driving unit (104) is integrally formed under the upper driving unit (102), collects information on user's position and movement, and includes a user detection sensor (160) that transmits the collected information to the computer (180). In an embodiment, the user detection sensor (160) may include a conventional Kinect sensor (162) that transmits the collected information to the computer (180).

Each side of the lower driving unit (104) is provided with a second workout unit (170) that is configured to rotate only by a predetermined angle toward the user and to allow the user to do muscle exercises, e.g., for strengthening biceps and triceps.

The second workout unit (170) includes a second driving member (178) that rotates by a predetermined angle to move a second handle (172) toward the user's side; a second handle (172) that the user grips when performing muscle exercises for the biceps and triceps; a variable wire (174) that allows entry and withdrawal of the second handle (172) toward and from the second workout unit (170); a piston (176) that is connected to an end of the variable wire (174) and allows the variable wire (174) to be withdrawn at a predetermined tension; and a pressure controller (175) that controls a level of the tension.

Here, the second handle (172) may further include a second contact sensor (172*a*) that detects contact with a user's hand and transmits a contact signal to the controller (400) when the contact between the second handle (172) and the user's hand is detected.

The controller (400) adjusts photographing angles of the front camera (110) and a rear camera (210) when the contact detection signal is transmitted from the first and second contact sensors (152*a* and 172*a*). It is preferable that the photographing angles is controlled by the Kinect sensor (162) configured in the user detection sensor (160) and based on the information about the position and the motion of the user which is transmitted from the VR trackerpad (10) detachably attached to the user's body.

The variable wire (174) may be made of a metal material having a predetermined rigidity, and further include a safety cover. The safety cover surrounds an outer surface of the variable wire (174) and is made of a synthetic resin and a fiber material so to prevent user injury by the variable wire (174) when the user performs a muscle exercise.

When the user performs a muscle exercise pulling the second handle (172), the piston (176) moves up and down inside the second workout unit (170), allowing the variable wire (174) to withdraw with a predetermined tension for user's muscle exercise. The pressure controller (175) provides a pressure required for the lifting operation of the piston (176) in the form of pneumatic or hydraulic pressure and is configured to adjust the amount of pressure supplied under the control of the computer (180).

On the other hand, the lower driving unit (104) of the present invention transmits and receives information to and from the controller (400), controls the operations of the first and the second workout units (150 and 170) under the control of the controller (400), and is provided with the computer (180) that displays on the display unit (130) the information transmitted from the controller (400).

Here, the computer (180) receives front and rear location and posture information of the user from the first camera (110) and a rear camera (210) and information about the distance between the user and the driving unit (100) and the VR unit (200) from front and rear laser sensors (120 and 220) and transmits the transmitted location and posture information and distance information to the controller (400).

The controller (400) generates posture correction information by comparing the location and posture information of the user transmitted from the computer (180) with the posture information pre-stored in a database (500) and transmits the generated posture correction information to the computer (180) and a VR device, allowing for the user to correct his or her posture.

The computer (180) displays on the display unit (130) the location and posture information and posture correction information transmitted from the controller (400). A communication unit may be provided at a rear side of the lower driving unit (104) and that allows data exchange among the computer (180), the controller (400), and the display unit (130) in a wired or wireless communication manner.

The VR unit (200) is configured to provide a VR fitness service to the user. The VR unit (200) includes: a control body (202) that collects image information and distance information about the rear location and posture information of the user; and a side body (204) that is provided on a side of the control body (202) and rotatably coupled to an exercise unit (300) to define an exercise space for the user.

The control body (202) may include a rear camera (210) and a rear laser sensor (220). The rear camera (210) photographs and transmits rear location and motion information of the user to the computer (180). The rear laser sensor (220) generates information about the distance between the back of the user and the control body (202) and transmits the information to the computer (180).

The rear camera (210) may be installed on both sides of the upper portion of the control body (202) and may further include a camera mounting unit (214) and a camera arm unit (212). The rear camera (210) is placed on the camera mounting unit (214) and rotates at 360 degrees in the up, down, left, and right directions under the control of the controller (400). An upper end of the camera arm unit (212) is rotatably connected to the camera mounting unit (214) and a lower end of the camera arm unit (212) is coupled to the upper end of the control body (202). Like in the case of the front camera (110), it is preferable that the camera driving actuator is further provided in the camera mounting unit (214).

The control body (202) includes: a headset and a VR device that are linked with the controller (400) so that the user can use the VR fitness service; and a VR accommodating unit (230) for accommodating a VR trackerpad (10) to which a VR tracker sensor is attached for detecting the location and posture of the user. In an embodiment of the present invention, it is preferred that the VR trackerpad (10) accommodated in the VR accommodating unit (230) is configured to be detachable by a velcro or the like to the user's body, preferably to one or more parts of the user's wrist, arms, waist, and legs.

The side body (204) is rotatably coupled to the bottom frame (310) of an exercise unit (300) which will be described later. When the real performs a bare hand exercise with any one of the first or the second workout units (150 and 170), the side body (204) defines open spaces on both sides of the user so that the bare hand exercise can be performed only in a limited space, allowing the bare hand exercise to be performed more safely.

The side body (204) further includes a rotation guide unit (240). An actuator, a motor, or the like is coupled to the front end of the rotation guide unit (240) and allows a rotation operation with respect to the bottom frame (310). The exercise unit (300) is configured between the driving unit (100) and the VR unit (200) and provides an exercise space for the user to perform an exercise in the virtual space and in the real space.

The exercise unit (300) includes: a bottom frame (310); a footrest unit (320) which is rotatably coupled to the bottom frame (310) and on which user foot is mounted; a separation prevention unit (330) provided on an outer circumferential surface of the footrest unit (320) and preventing a departure of the user from the footrest unit (320); a back support frame (340) provided on the back of the user and a waist protector (370) that is connected to the back support frame (340) and surrounds the user's waist.

The bottom frame (310) is placed on the ground. In the rear direction, the side body (204) is rotatably coupled to the bottom frame (310) by the rotation guide unit (240). In the front direction, the rear camera (210) and the driving unit (100) are connected to the bottom frame (310). The bottom frame (310) includes a connection bar (312) that contains a communication cable for allowing the computer (180) to interwork with a rear laser sensor (220) and the controller (400).

In addition, the bottom frame (310) is further provided with a rotation unit (380) for rotating the footrest unit (320). The footrest unit (320) can be rotatably coupled to the bottom frame (310).

Here, the rotation unit (380) is coupled to a rotary shaft (322), which is provided in the lower portion of the footrest uanit (320), by a gear coupling method to rotate the rotary shaft (322) under the control of the controller (400). The rotation unit (380) includes: a rack gear unit (384) coupled with the rotary shaft (322); and a rack drive unit (382) that drives the rack gear unit (384) when a drive signal is transmitted from the controller (400).

The footrest unit (320) is provided on the bottom frame (310) and is rotated by the rotation unit (380). The footrest unit (320) provides a predetermined exercise space where the user stands and performs a fitness exercise in both virtual space and real space through the VR fitness service. The footrest unit (320) is provided between the driving unit (100) and the VR unit (200) and maintain an interval of 1 m to 1.5 m to prevent interference from surroundings, allowing a safe exercise when the user performs an exercise.

The separation prevention unit (330) is provided on the outer circumference of the footrest unit (320) and includes a lighting unit (332). When the user departs from the footrest unit (320) and makes contact with the separation prevention unit (330), the lighting unit (332) emits light to warn of departure.

The back support frame (340) is located spaced apart from the upper part of the bottom frame (310), is located at the back of the user, and is connected with the waist protector (370) to prevent the user from falling from the footrest unit when the user performs an exercise both in the virtual space and in the real space. A connection unit (360) is further provided to connect the back support frame (340) to the waist protector (370). The back support frame (340) may include: an adjustment guide (350) for allowing height adjustment of the waist protector (370); and an adjustment hole (342) for guiding the up and down movement of the adjustment guide (350).

In order for the back support frame (340) to be coupled to the bottom frame (310) at a predetermined interval, a fixing frame (344) can be coupled to the bottom of the back support frame (340). In an embodiment, the fixing frame (344) is a support leg, but is not limited thereto.

The connection unit (360) is preferably made of a soft material such as spring or rubber so that the user can take various postures, such as twisting posture and sitting down and standing up posture, on the footrest unit (320). The controller (400) interworks with the computer (180) to allow the user to perform a bare hand exercise in the virtual space as well as in the real space and to output the image information of the user.

The controller (400) adjusts the angles of the front and rear cameras (110 and 210) according to the contact signals transmitted from the first and second contact sensors (152*a* and 172*a*). The controller (400) generates posture correction information by comparing the location and posture information of the user transmitted from the computer (180) with the pre-stored posture information stored in the database (500) and transmits the generated posture correction information to the computer (180) and the VR device so that the posture correction of the user can performed.

When the user wants to perform an exercise in both the virtual space and the real space using the personal fitness machine of the present invention, the controller (400) interworks with the equipment stored in the VR accommodating unit (230) (the headset, the VR device, the VR trackerpad (10), etc.) so that the user can exercise in the real space as well as in the virtual space.

In addition, when the user wants to perform an exercise in the virtual space, the controller (400) of the present invention can provide a trainer selection menu for the user to select a virtual trainer who is existing only in the virtual space. The trainer selection menu may be activated once user authentication and payment completes through the authentication and payment unit (140).

The information about the virtual trainer may be stored in the database (500), and the virtual trainer may be made of with an appearance of a famous person such as a celebrity or of a family member. When the user's selection is made, the virtual trainer is exposed in the virtual space and may provide various voice messages according to the user's exercise posture.

On the other hand, when the user performs an exercise in the virtual space, the environmental information output through the virtual space may be changed by the controller (400). The environmental information may be stored in various forms in the database (500) and is stored after being classified by categories such as weather and natural disasters.

For example, when a user exercises with the first workout unit (150) that allows a bar-hanging exercise, a bar actually comes down 90 degrees and is placed above the user's head in the real space. At the same time, in the virtual space, a bar that is located a few meters away extends its length to be placed above the user's head; as soon as the user hangs onto the bar, the floor disappears and lava flows on the ground; and if the user does not hang onto the bar for a certain amount of time, the floor does not appear again. In such a way, the exercise can be more fun and effective.

The terms such as "comprise," "include," "configure," and "having" used above mean that a corresponding component may be included unless specifically stated otherwise, and thus should be construed that it may further include other components. All terms including technical or scientific terms should be understood in the manner that an ordinary person skilled in the art generally understands, unless otherwise instructed. In addition, the above description is merely illustrative of the technical idea of the present invention, and those skilled in the art to which the present invention pertains may make various modifications and variations without departing from the essential characteristics of the present invention.

The embodiments disclosed in the present invention are not intended to limit the technical idea of the present invention but to describe the present invention, and the scope of the technical idea of the present invention is not limited by these embodiments. The scope of the present invention should be interpreted by the following claims, and all technical ideas within the equivalent scope should be interpreted as being included in the scope of the present invention.

EXPLANATION OF REFERENCE NUMERALS SHOWN IN DRAWINGS

| | |
|---|---|
| 100: driving unit | 102: upper driving unit |
| 104: lower driving unit | 110: front camera |
| 120: front laser sensor | 130: display unit |
| 140: authentication and payment unit | 150: first workout unit |
| 160: user detection sensor | 170: second workout unit |
| 180: computer | 200: VR unit |
| 202: control body | 204: side body |
| 210: rear camera | 220: rear laser sensor |
| 230: VR accommodating unit | 240: rotation guide unit |
| 300: athletic body | 310: bottom frame |
| 320: footrest unit | 330: separation prevention unit |
| 340: back support frame | 350: adjustment guide |
| 360: connection unit | 370: waist protector |
| 380: rotation unit | 400: control unit |
| 500: database | |

What is claimed is:

1. A personal fitness device using VR, comprising:

a driving unit that collects front location information of a user and front posture information of the user, displays virtual image information of the user in a virtual space, and includes an exercise device with which the user exercises in the virtual space and in a reality space;

a VR unit that includes a control body and a side body and defines an exercise space of the user, wherein the control body collects rear location information, rear posture information, and distance information of the user, wherein the side body is provided on a side of the control body and is rotatably coupled to the driving unit;

an exercise unit that includes a bottom frame, a footrest unit, a separation prevention unit, a back support frame, and a waist protector, wherein the footrest unit is rotatably coupled onto the bottom frame, wherein the separation prevention unit is provided on an outer circumference the footrest unit and prevents the user from departing from the footrest while the user exercises, wherein the waist protector is connected to the back support frame; and a controller coupled to the driving unit, wherein the controller controls the driving unit, the VR unit, and the exercise unit, compares the front posture information of the user and pre-stored posture information, and generates posture correction information, wherein the front posture information of the user is transmitted from the driving unit, wherein the pre-stored posture information is pre-stored in a database.

2. The personal fitness device of claim 1, wherein the driving unit comprises:

a front camera which collects the front posture information of the user;

a front laser sensor which collects front distance information between the driving unit and the user;

a display unit which displays the virtual image information of the user in the virtual space and reality image information of the user in the reality space;

an authentication and payment unit which authenticates a user identity and processes payment;

a first workout unit with which the user exercises in the reality space;

a user detection sensor which collects location and movement information of the user;

a second workout unit with which the user performs a second exercise; and a computer which drives the handle workout unit and the second workout unit under the control of the controller and displays the front posture information of the user transmitted from the controller on the display unit.

3. The personal fitness device of claim 2, wherein the second workout unit comprises:

a second handle;

a second driving member which allows the second handle to move at a second angle toward the user;

a variable wire which is coupled to the second handle and allows the second handle to be pulled into and pulled out from the second workout unit;

a piston which is coupled to an end of the variable wire and allows the variable wire to be pulled out at a first tension; and a pressure controller which adjusts the first tension.

4. The personal fitness device of claim 3, wherein the controller controls and rotates at 360 degrees the front camera and a rear camera, wherein the front camera is coupled to the driving unit, wherein the rear camera is coupled to the VR unit.

5. The personal fitness device of claim 2, wherein the first workout unit comprises:

a first handle;

a rotation bar which allows the first handle to move toward the user;

a support bar which connects the rotation bar to the first handle;

a first driving member which is controlled by the computer and rotates the rotating bar at a first angle; and a stopper panel which prevents the rotation bar from rotating beyond the first angle.

6. The personal fitness device of claim 1, wherein the control body comprises:

a rear camera which collects the rear location information of the user and the rear posture information of the user;

a rear laser sensor generating rear distance information between the user and the control body; and a VR accommodating unit which interacts with the controller and stores VR equipment, wherein the VR equipment includes a headset, a VR device, and a VR tracker sensor, wherein the VR equipment connects the reality space to the virtual space.

7. The personal fitness device of claim 1, wherein the bottom frame further comprises: a rotating member which rotatably couples the footrest unit to the bottom frame.

8. The personal fitness device of claim 1, wherein the controller provides a trainer selection menu, wherein the trainer selection menu allows the user to select a virtual trainer in the virtual space and allows the user to configure environment of the virtual space.

* * * * *